US011280093B2

(12) United States Patent
Anderson et al.

(10) Patent No.: US 11,280,093 B2
(45) Date of Patent: Mar. 22, 2022

(54) FORMING A TRANSITION BETWEEN TWO SURFACES OF DIFFERENT ELEVATION

(71) Applicant: EZ Flex LLC, Fort Worth, TX (US)

(72) Inventors: Benjamin Hewitt Anderson, Southlake, TX (US); Cody Blake Anderson, Aledo, TX (US); Robert Wade Garrett, Fort Worth, TX (US)

(73) Assignee: EZ Flex LLC, Fort Worth, TX (US)

( * ) Notice: Subject to any disclaimer, the term of this patent is extended or adjusted under 35 U.S.C. 154(b) by 290 days.

(21) Appl. No.: 16/672,173

(22) Filed: Nov. 1, 2019

(65) Prior Publication Data

US 2020/0407978 A1 Dec. 31, 2020

Related U.S. Application Data

(60) Provisional application No. 62/866,930, filed on Jun. 26, 2019.

(51) Int. Cl.
*E04F 11/00* (2006.01)

(52) U.S. Cl.
CPC ..... *E04F 11/002* (2013.01)

(58) Field of Classification Search
CPC ..... E04F 11/002; E04F 2011/005; E04F 2011/007; E04F 19/028; A47C 7/021; A47C 7/0213; A47C 7/14; A47C 7/144; A47C 3/16; A47C 16/04; A47G 2009/1018; A47G 9/1045
See application file for complete search history.

(56) References Cited

U.S. PATENT DOCUMENTS 65,262 A * 5/1867 Ouroussoff ..... A47C 27/00 5/420
681,573 A * 8/1901 Nichols ..... A47C 27/001 5/722
2,877,472 A * 3/1959 Wagner ..... A47G 9/10 5/636

(Continued)

OTHER PUBLICATIONS

"Spring Floor Border Wedges", accessed May 20, 2019 at https://www.norberts.net/categories/Gymnastic-Mats/Spring-Floor-Systems/Floor-Accessories/Spring-Floor-Border-Wedges/, 1 pg.

*Primary Examiner* — Kyle J. Walraed-Sullivan
(74) *Attorney, Agent, or Firm* — Henry Patent Law Firm PLLC

(57) ABSTRACT

In a general aspect, a mat is disclosed for forming a transition between two surfaces of different elevation. The mat includes a carpeted layer secured to a foam layer. The foam layer includes first, second, third and fourth sides that define a perimeter of the foam layer. The foam layer also includes first and second channels extending in-plane through the foam layer from the first side to the second side. The first and second channels are configured to allow the mat to fold around a first folding axis into a folded position. The foam layer additionally includes relief cuts extending in-plane through the foam layer from the third side to the fourth side. The relief cuts are configured to allow the mat to fold around a second folding axis into a rolled position. A fifth side of the foam layer is mated to the carpeted layer, and a sixth side of the foam layer defines an interior boundary of the mat when the mat is in the folded position.

9 Claims, 8 Drawing Sheets

(56) References Cited

U.S. PATENT DOCUMENTS 4,137,583 A * 2/1979 Baldwin ..... A63C 19/04 482/23
4,275,473 A * 6/1981 Poirier ..... A47C 27/146 441/128
4,654,245 A * 3/1987 Balzer ..... A47L 23/26 428/192
4,761,847 A * 8/1988 Savage ..... B65G 69/30 108/167
4,987,625 A * 1/1991 Edelson ..... A47C 20/026 5/420
5,086,529 A * 2/1992 DeGroot ..... A47C 27/001 5/710
5,121,961 A * 6/1992 Marshall ..... A47C 1/143 297/17
5,369,826 A * 12/1994 Ikeda ..... A47C 20/04 5/191
7,020,918 B1 * 4/2006 Tinsley ..... A47C 16/00 5/630
7,849,646 B2 12/2010 Harinishi
10,251,808 B1 * 4/2019 Theis ..... A61H 19/32
2006/0082198 A1 * 4/2006 Mafrice ..... A63F 13/08 297/217.4
2007/0082177 A1 * 4/2007 Robbins, III ..... A47C 27/001 428/167
2008/0118671 A1 * 5/2008 Bienkiewicz ..... A47G 9/062 428/12
2009/0165414 A1 7/2009 Burk et al.
2009/0305849 A1 12/2009 Weller
2013/0276238 A1 * 10/2013 Vega-Woller ..... A47D 15/003 5/703
2014/0101848 A1 * 4/2014 Murphy ..... A47G 9/08 5/420
2016/0081500 A1 * 3/2016 Bradshaw ..... A47G 9/10 5/640

* cited by examiner

FORMING A TRANSITION BETWEEN TWO SURFACES OF DIFFERENT ELEVATION

CROSS-REFERENCE TO RELATED APPLICATIONS

This application claims priority to U.S. Provisional Application No. 62/866,930 filed Jun. 26, 2019 and entitled "Forming a Transition Between Two Surfaces of Different Elevation." The entire contents of the priority application are hereby incorporated by reference.

BACKGROUND

The following description relates to forming a transition between two surfaces of different elevation.

Two surfaces of different elevation are commonly found in the environment. For example, pairs of lower and upper steps can serve as a basis for a staircase, a sidewalk may be raised relative to a street may by a curb, a boxing ring may be lifted off of a ground floor by vertical supports, and so forth. A mechanical structure can aid a person, animal, or object in moving from a lower of the two surfaces to an upper of the two surfaces.

DETAILED DESCRIPTION

In some aspects of what is described here, a mat is disclosed for forming a transition between two surfaces of different elevation. The mat may be configurable into a border that can be disposed against a side of a spring floor used for athletic competitions (e.g., cheerleading, gymnastics, etc.). Other applications, however, possible (e.g., transitions for concert stages, speaking podiums, etc.). In some instances, the mat may provide an inclined wall leading from a lower of the two surfaces to an upper of the two surfaces (or vice versa). The mat may also have an outer carpeted layer that can be selected to provide cosmetic features (e.g., color, texture, pattern, etc.) that aesthetically pleasing for an intended application. For example, a spring floor may have a black, carpeted surface that serves as a working surface for athletic activities. The mat may be configured with a black carpeted outer layer to match that of the spring floor, thereby provide an aesthetically-pleasing transition to the spring floor from a ground floor supporting the spring floor.

In some implementations, the mat includes a carpeted layer secured to a foam layer. The foam layer includes first, second, third and fourth sides that define a perimeter of the foam layer. The foam layer also includes first and second channels extending in-plane through the foam layer from the first side to the second side. The first and second channels are configured to allow the mat to fold around a first folding axis into a folded position. The foam layer additionally includes relief cuts extending in-plane through the foam layer from the third side to the fourth side. The relief cuts are configured to allow the mat to fold around a second folding axis into a rolled position. A fifth side of the foam layer is mated to the carpeted layer, and a sixth side of the foam layer defines an interior boundary of the mat when the mat is in the folded position.

With this configuration, the mat may allow a user to rapidly convert the mat from a stored position (e.g., the rolled position, a flat position, etc.) into the folded position. The configuration may also allow the user to quickly set up long, perimeter installations of the mat. For example, for a rectangular spring floor, the user may be able to set up four instances of the mat (i.e., one instance for each side of the spring floor) versus conventional mechanical assemblies, which may require up to twenty-three individual assemblies. The configuration may also allow a smoother transition from the mat to the lower of the two surfaces, and as such, may eliminate (or substantially reduce) trip or catch hazards commonly to conventional mechanical assemblies. Such assemblies often include raised edges where they meet the lower of the two surfaces.

Figure 1A:
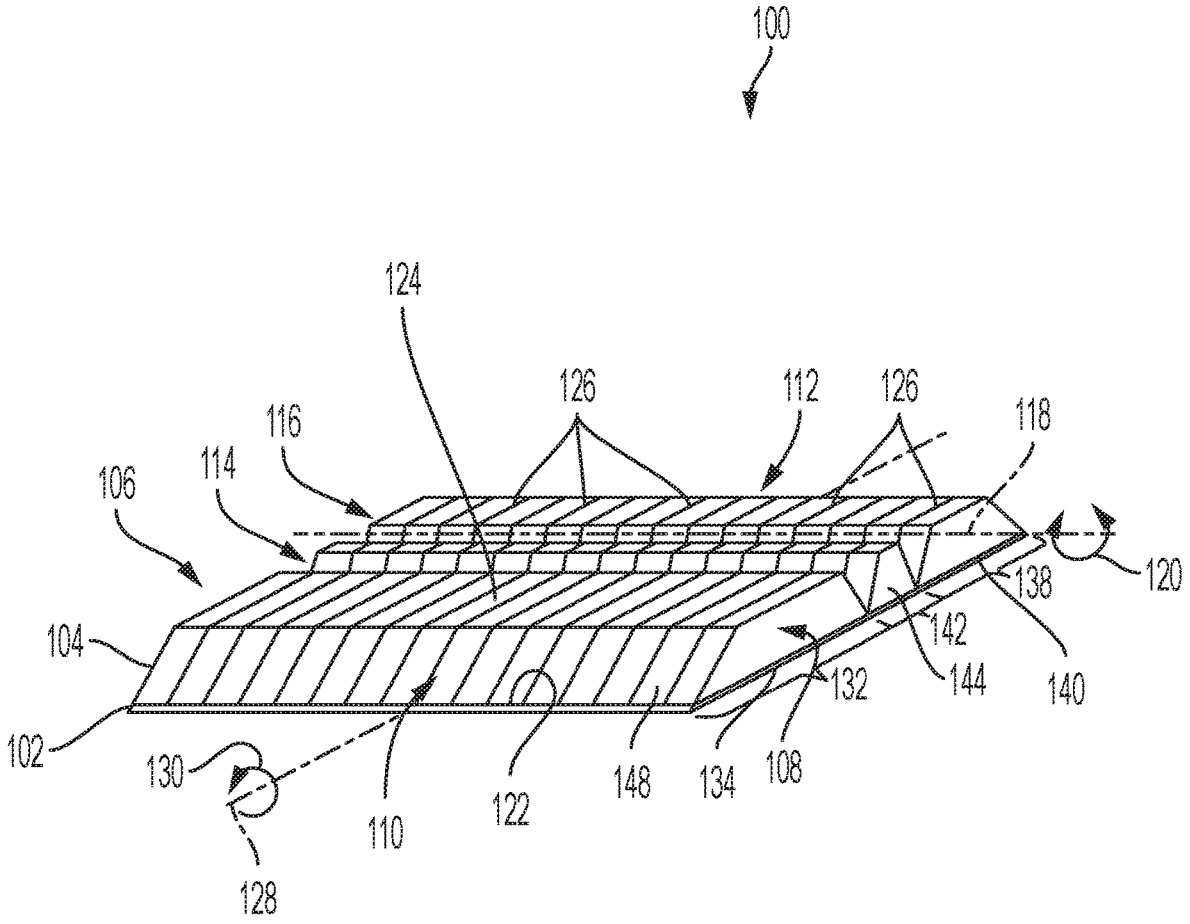
FIG. 1A is a schematic diagram, in perspective view, of an example mat for forming a transition between two surfaces of different elevation.

Now referring to FIG. 1A, a schematic diagram is presented, in perspective view, of an example mat 100 for forming a transition between two surfaces of different elevation. FIG. 1A illustrates the example mat 100 laid flat. However, other positions of the example mat 100 are possible, as will be described below.

The example mat 100 includes a carpeted layer 102 secured to a foam layer 104. The carpeted layer 102 may be formed of a woven fabric suitable for persons, animals, and objects to contact and traverse the carpeted layer 102 (e.g., by walking on, rolling on, etc.). In some instances, the woven fabric is adapted to couple to a hook and loop fastener (e.g., a strap, tape, etc.) upon contact with the hook and loop fastener. The foamed layer may be an open or closed cellular material formed of polyethylene, cross-linked polyethylene, polyurethane, reticulated polyurethane, latex rubber, neoprene rubber, or other type of material. For example, the foam layer 104 may be a closed cellular material formed of cross-linked polyethylene. In some instances, the foam layer 104 includes a plurality sub-layers (e.g., two sub-layers, three sub-layers, etc.). The plurality of sub-layers may be formed of the same material, or alternately, one or more of the sub-layers in the plurality of sub-layers may be formed of different materials. For example, the plurality of sub-layers may include two sub-layers, each formed of different materials to engineer a compliance of the example mat 100. The compliance may determine a response of the example mat 100 to contact or impact along an exterior surface of the carpeted layer 102.

In some implementations, such as shown in FIG. 1A, the carpeted layer 102 has a thickness less than a thickness of the foam layer 104. For example, the carpeted layer 102 may have a thickness less than 10% of a thickness of the foam layer 104. In another example, the thickness of the carpeted layer 102 may be less than 5% of the thickness of the foam layer 104. In yet another example, the thickness of the carpeted layer 102 may be less than 2% of the thickness of the foam layer 104. Other percentages are possible (e.g., less than 1%).

The foam layer 104 includes first 106, second 108, third 110, and fourth 112 sides that define a perimeter of the foam layer 104. The first side 106 is opposite of the second side 108, and the third side 110 is opposite the fourth side 112. The foam layer 104 also includes first and second channels 114, 116 extending in-plane through the foam layer 104 from the first side 106 to the second side 108. The first and second channels 114, 116 are configured to allow the example mat 100 to fold around a first folding axis 118 into a folded position. For example, the example mat 100 may be folded around the first folding axis 118 in directions indicated by double-arrow 120 to reach the folded position. The first and second channels 114, 116 may be parallel to the first folding axis 118.

In many instances, the first and the second channels 114, 116 are parallel to each other. However, in certain instances, the first and the second channels 114, 116 may be angled relative to each other. Although FIG. 1A depicts the example mat 100 as having two channels, other numbers of channels are possible. For example, the example mat 100 may include a third channel, a fourth channel, and so forth. Moreover, the channels may have any type of cross-section that allows the example mat 100 to fold around a first folding axis 118 into a folded position (e.g., triangular, hemispherical, U-shaped, etc.). The cross-section may vary along a length of a channel and need not be the same for all channels.

Figure 1B:
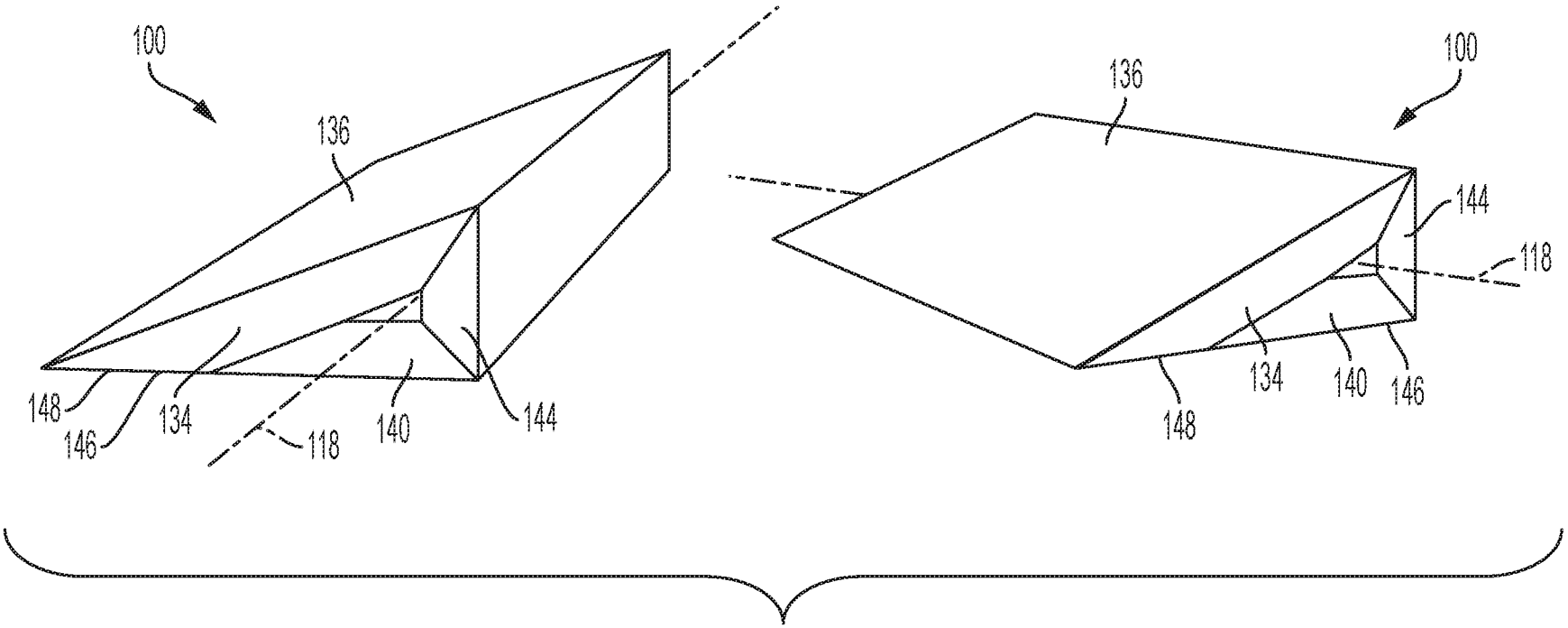
FIG. 1B is a schematic diagram, shown in two perspective views, of the example mat of FIG. 1A in the folded position.

FIG. 1B presents a schematic diagram, shown in two perspective views, of the example mat 100 of FIG. 1A in the folded position. Example dimensions are shown in the top perspective view for certain features of the example mat 100. However, other dimensions are possible. Now referring to both FIGS. 1A & 1B, first portions 132 of the carpeted and foam layers 102, 104 between the third side 110 of the perimeter and the first channel 114 may define a first wall 134. The first wall 134 includes a transition surface 136 configured to extend from the lower of the two surfaces (not shown) to the upper of the two surfaces (not shown) when the mat is the folded position. Although FIGS. 1A & 1B depict the transition surface 136 as a planar surface, other types of surfaces are possible (curved, textured, patterned, etc.). Similarly, second portions 138 of the carpeted and foam layers 102, 104 between the second channel 116 and the fourth side 112 of the perimeter may define a second wall 140, and third portions 142 of the carpeted and foam layers 102, 104 between the first and second channels may define a third wall 144.

In some variations, the first wall 134 may be inclined relative to the second wall 140 and the transition surface 136 may include an inclined surface. The second wall 140 may also include a base surface 146 configured to be supported by the lower of the two surfaces. In some variations, a beveled surface 148 may terminate the carpeted and foam layers 102, 104 at the third side 110. The beveled surface 148 may be angled with respect to the sixth side 124 to allow the beveled surface 148 to serve as part of the base surface 146 of the example mat 100. In certain instances, such as shown in FIGS. 1A & 1B, the beveled surface 148 is angled at an acute angle relative to a plane of the sixth side 124. The beveled surface 148 may allow the transition surface 136 to directly meet the lower of the two surfaces and provide a smooth transition thereto. Such meeting may prevent the third side 110 of example mat 100 from defining an elevated edge that might otherwise create a trip or catch hazard.

In some variations, the foam layer 104 is configured such that the first and second channels 114, 116 are closed when the mat is in the folded position. Such closing may leave a partial gap within the first and second channels 114, 116, or alternatively, leave no gap. The foam layer 104 may also be configured such that portions of the foam layer 104 adjacent sides of the first and second channels are uncompressed when the first and second channels 114, 116 are closed. Such sides may include one or more lateral sides, one or more base sides adjacent the carpeted layer 102, or some combination thereof. The lack of compression may serve to reduce a resistance to folding the example mat 100 into the folded position. In some variations, such as shown in FIG. 1B, the example mat 100 is configured such that, when in folded position, the example mat 100 has a triangular cross-section. The triangular cross-section may define a right triangle. In such cases, a portion of the example mat 100 defining a hypotenuse leg of the right triangle (e.g., the first wall 134) may serve as an inclined wall capable of providing the transition between the two surfaces of different elevation.

Now referring back to FIG. 1A, the foam layer 104 additionally includes a fifth side 122 mated to the carpeted layer 102, and a sixth side 124 that defines an interior boundary of the example mat 100 when the example mat 100 is in the folded position. In some implementations, a distance from the fifth side 122 to the sixth side 124 defines a thickness of the foam layer 104. In some instances, such as shown in FIG. 1A, the first and second channels 114, 116 may have a depth extending through the foam layer 104 (or the thickness of the foam layer 104) to the carpeted layer 102. For example, the foam layer 104 may have a thickness of 2 inches and a depth of the first and second channels 114, 116 through the foam layer 104 may be 2 inches. However, in other instances, the first and second channels 114, 116 have a depth from the sixth side 124 that is less than the thickness of the foam layer 104. For example, the foam layer 104 may have a thickness of 2 inches and a depth of the first and second channels 114, 116 through the foam layer 104 may be about 1.9 inches (e.g., 1.897 inches). In some instances, the first and second channels 114, 116 may have a depth that is at least 90% of the thickness of the foam layer 104. In some instances, the first and second channels 114, 116 may have a depth that is at least 95% of the thickness of the foam layer 104. Other percentages, however, are possible (e.g., at least 99%). The depth of the first channel 114, the second channel 116, or both, may have a depth that varies from the first side 106 to the second side 108.

The foam layer 104 further includes relief cuts 126 extending in-plane through the foam layer 104 from the third side 110 of the perimeter to the fourth side 112. The relief cuts 126 are configured to allow the example mat 100 to fold around a second folding axis 128 into a rolled position. The relief cuts 126 may be parallel to the second folding axis. In many implementations, the foam layer 104 is configured such that the carpeted layer 102 is inward-facing and the foam layer 104 is outward-facing when the example mat 100 is in the rolled position. For example, starting at the first side 106, the example mat 100 may be folded around the second folding axis 128 in a direction indicated by single-arrow 130 to reach the rolled position. The relief cuts 126 may be disposed in the foam layer 104 parallel to each other. However, in certain instances, the relief cuts 126 may be angled relative to each other. In some implementations, such as shown in FIG. 1A, the relief cuts 126 are perpendicular to the first and second channels 114, 116, and the second folding axis 128 is perpendicular to the first folding axis 118.

The foam layer 104 may include any number of relief cuts 126. Moreover, the relief cuts 126 may have any type of cross-section that allows the example mat 100 to fold around the second folding axis 128 into the rolled position. The cross-section may vary along a length of the relief cuts 126 and need not be the same for all relief cuts 126. In some implementations, such as shown in FIG. 1A, the relief cuts 126 define slits extending in-plane through the foam layer 104 from the third side 110 of the perimeter to the fourth side 112. In some implementations, the relief cuts 126 define grooves (e.g., triangular, hemispherical, U-shaped, etc.) extending in-plane through the foam layer 104 from the third side 110 of the perimeter to the fourth side 112.

In implementations where a distance from the fifth side 122 to the sixth side 124 defines a thickness of the foam layer 104, the relief cuts 126 may also have a depth from the sixth side 124 that is equal to the thickness of the foam layer 104. For example, the foam layer 104 may have a thickness of 2 inches and a depth of the relief cuts 126 may be 2 inches. However, in some variations, the depth of the relief cuts 126 may be less than the thickness of the foam layer 104. For example, the foam layer 104 may have a thickness of 2 inches and a depth of relief cuts 126 may be about 1.9 inches (e.g., 1.897 inches). In some instances, the relief cuts 126 may have a depth that is at least 90% of the thickness of the foam layer 104. In some instances, the relief cuts 126 may have a depth that is at least 95% of the thickness of the foam layer 104. Other percentages, however, are possible (e.g., at least 99%). One or more of the relief cuts may have a depth that varies from the third side 110 to the fourth side 112.

Figure 2A:
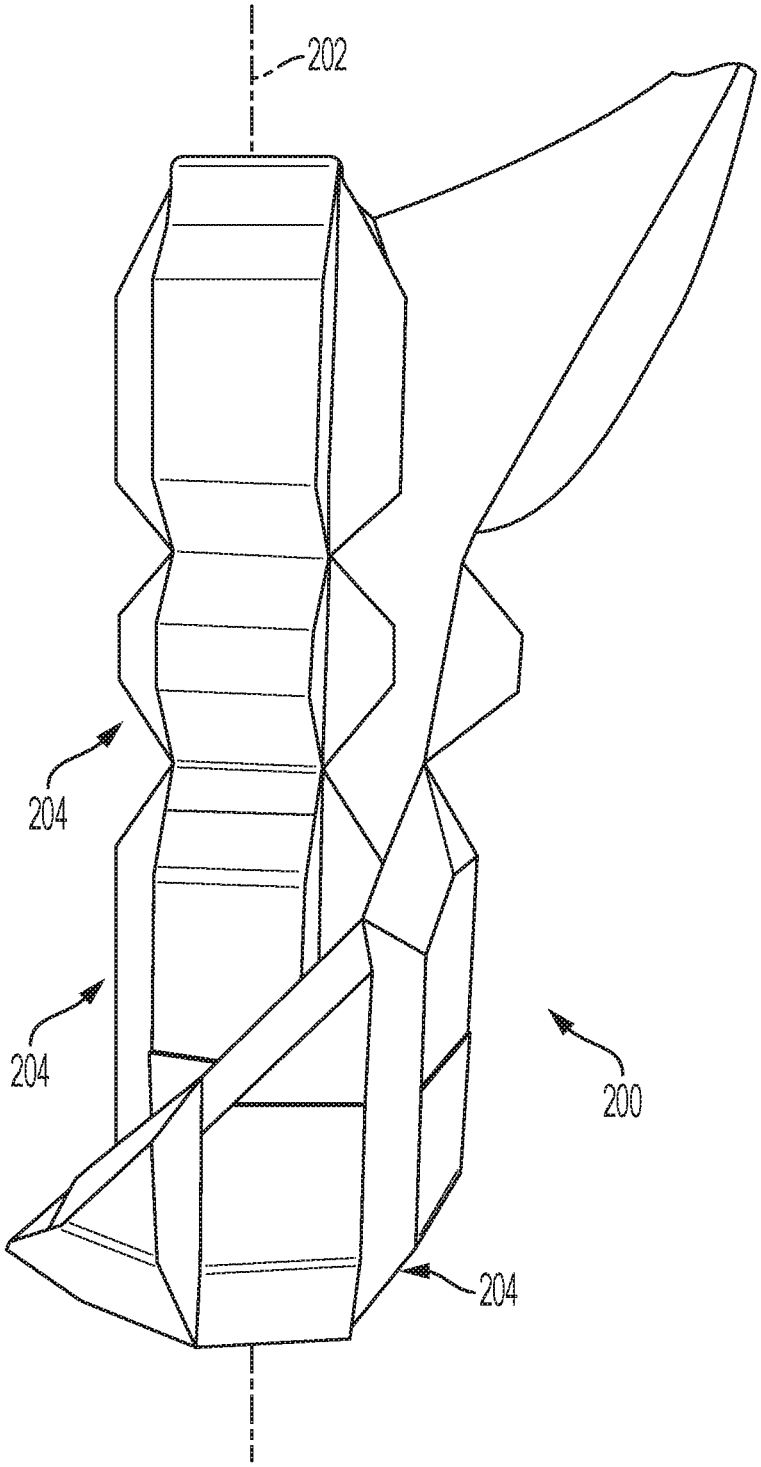
FIG. 2A is a photograph, taken in side view, of an example mat in a rolled position about a second folding axis.
Figure 2B:
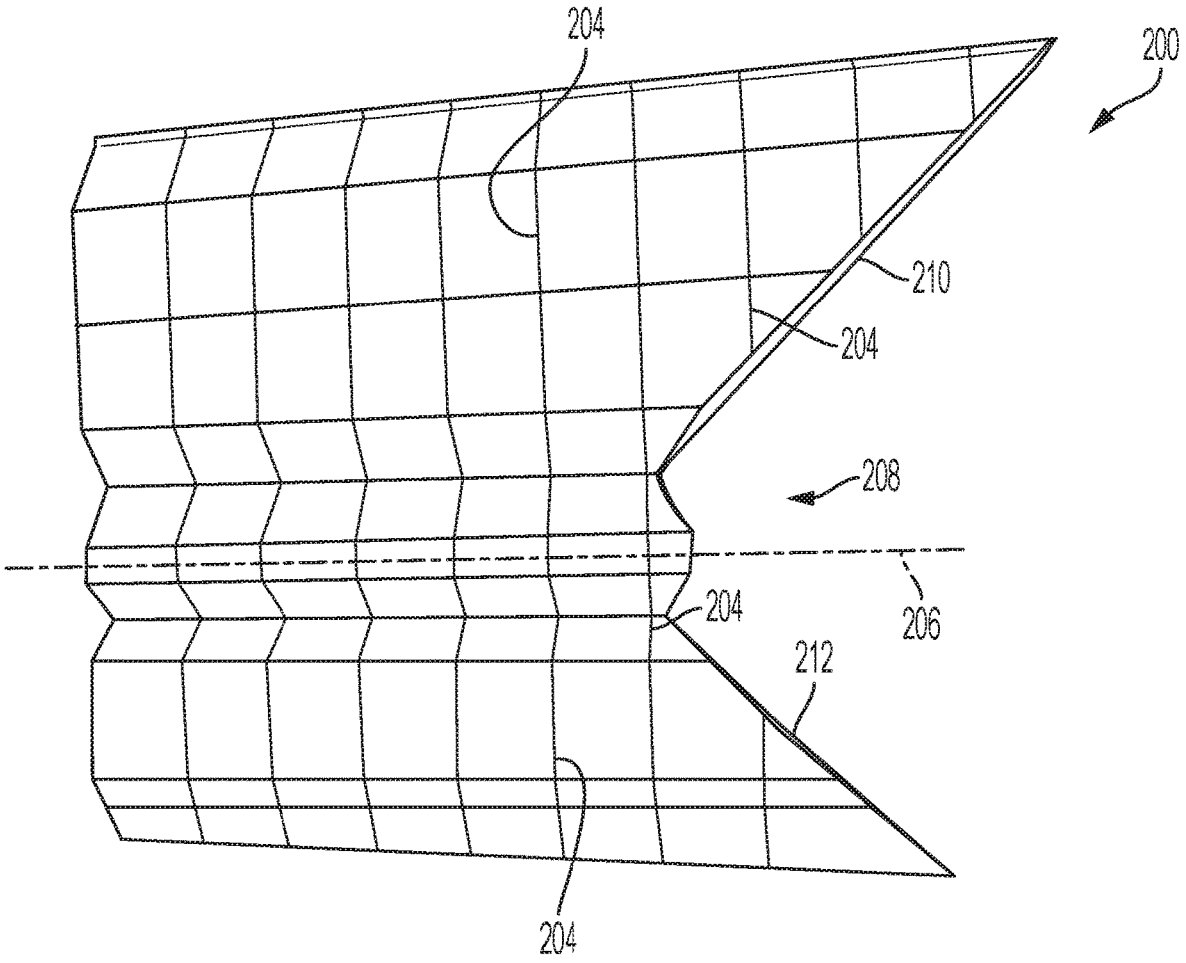
FIG. 2B is a photograph of the example mat of FIG. 2A, but in which the example mat 200 is laid flat.
Figure 3:
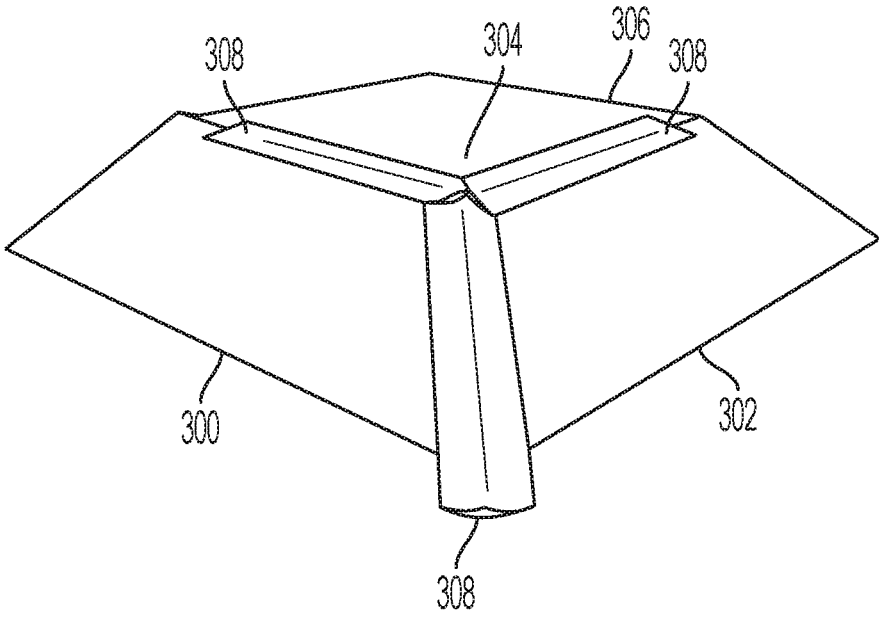
FIG. 3 is a photograph, taken in perspective view, of a corner deployment of two example mats at a corner of a spring floor.

FIG. 2A presents a photograph, taken in side view, of an example mat 200 in a rolled position about a second folding axis 202. The example mat 200 may be analogous to the example mat 100 of FIGS. 1A & 1B. The example mat 200 includes relief cuts 204, open to allow the example mat 200 to be in the rolled position. FIG. 2B presents a photograph of the example mat 200 of FIG. 2A, but in which the example mat 200 is laid flat. The relief cuts 204 of the example mat 200 are closed to allow the example mat 200 to lay flat. In use, the relief cuts 204 may also remain closed to allow the example mat 200 to fold around a first folding axis 206 into a folded position, if desired. In FIG. 2B, a second side 208 of the example mat includes a pair of angled portions 210, 212. Such portions may allow the example mat to form an angled end when in the folded position, thereby allowing two instances of the example mat 200 to be placed at a corner defined by at least the upper of the two surfaces. An example of such a corner deployment is shown by FIG. 3. In FIG. 3, two example mats 300, 302 are deployed around a corner 304 of a spring floor 306 to define a transition having a 90° change in direction. The two example mats 300, 302 are secured to each other and each to the spring floor 306 by hook and loop fasteners 308.

Now referring back to FIGS. 1A & 1B, the perimeter of the foam layer 104 may be shared in common with the carpeted layer 102. In these cases, the perimeter may allow the example mat 100 to define predetermined shapes when in the folded position. These predetermined shapes may allow multiple instances of the mat to be disposed against each other (e.g., at the ends) to define various configurations of a border. In some implementations, the example mat 100 is sized such that the example mat 100, when in the folded position, can form a walking surface between a spring floor and a base floor that supports the spring floor.

Figure 4A:
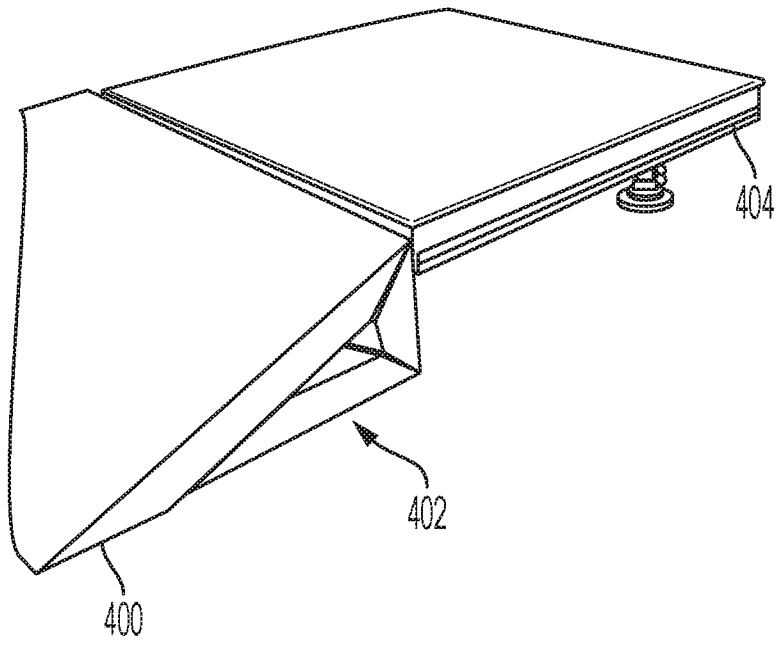
FIG. 4A is a photograph, shown in perspective view, of an example mat having a blocked end.

For example, as shown in FIGS. 1A & 1B, the perimeter of the foam layer 104 may be rectangular perimeter when the example mat 100 is laid flat. If the foam layer 104 also shares the perimeter in common with the carpeted layer 102, the example mat 100 can define a triangular prismatic volume having blocked ends. The blocked ends may allow multiple instances of the example mat 100 to be disposed against each other to define a straight-running transition (e.g., a straight-running border for a spring floor). FIG. 4A presents a photograph, shown in perspective view, of an example mat 400 having a blocked end 402. The example mat 400 is disposed against a side of a spring floor 404, which serves as upper of two surfaces.

Figure 4B:
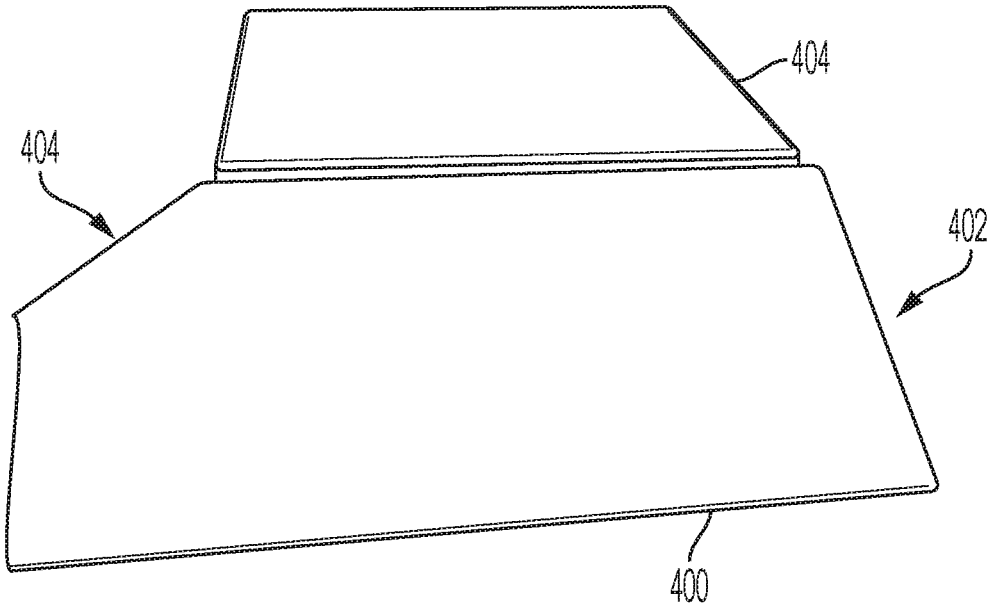
FIG. 4B is a photograph of the example mat of FIG. 4A, but shown in a perspective view that includes the blocked end and an angled end.

In another example, the first side 106 or the second side 108 may include a pair of angled portions such that the perimeter defines, at least partially, a V-shaped indent when the mat is laid flat. If the foam layer 104 also shares the perimeter in common with the carpeted layer 102, the example mat 100 can define a triangular prismatic volume having a single angled end. The single angled end may allow two instances of the example mat 100 to be disposed against each other to change a direction of an otherwise straight-running transition. This change may allow the two instances of the example mat 100 to define a corner for an otherwise straight-running boarder encircling a rectangular spring floor. FIG. 4B presents a photograph of the example mat 400 of FIG. 4A, but shown in a perspective view that includes the blocked end 402 and an angled end 404.

Similarly, the first side 106 and the second side 108 may each include a pair of angled portions such that the perimeter defines, at least partially, a bow-tie shape when the mat is laid flat. If the foam layer 104 also shares the perimeter in common with the carpeted layer 102, the example mat 100 can define a triangular prismatic volume which each end is angled. The pair of angled ends may allow four instances of the example mat 100 to be disposed against each other to define a rectangular transition (e.g., a rectangular border around a rectangular spring floor). The angles associated with the angled ends may be predetermined to define other polygons for the transition (e.g., triangles, pentagons, hexagons, octagons, etc.).

During use, the example mat 100 may be folded by a user around the first folding axis 118 into the folded position. In particular, the user may grab the third side 110 and fold the example mat 100 along a first crease line associated with a first base portion of the first channel 114. The first base portion includes a portion of the carpeted layer 102 aligned with the first channel 114, and in some implementations, may also include a portion of the foam layer 104 in the first channel 114. Similarly, the user may grab the fourth side 112 and fold the example mat 100 along a second crease line associated with a second base portion of the second channel 116. The second base portion includes a portion of the carpeted layer 102 aligned with the second channel 116, and in some implementations, may also include a portion of the foam layer 104 in the second channel 116. During folding of the example mat 100 into the folded position, the first and second base portions act as elastic, reversible hinges that open and close in response to displacement of, respectively, the first wall 134 relative to the third wall 144 and the second wall 140 relative to the third wall 144. During folding of the example mat 100 into the folded position, the user may close the first and second channels 114, 116. The relief cuts 126 remain closed (or substantially so) as the example mat 100 is displaced around the first folding axis 118.

Once the example mat 100 is in the folded position, the user may choose to secure the example mat 100 in the folded position. For example, the user may couple one or both of the carpeted layer 102 and the foam layer 104 proximate the third side 110 of the perimeter to one or both of the carpeted layer 102 and the foam layer 104 proximate the fourth side 112 of the perimeter. After securing the example mat 100, the user may proceed to place the folded and secured example mat 100 on a lower of two surfaces and adjacent to an upper of two surfaces. When the example mat 100 has been placed, the first wall 134 provides a transition surface extending from a lower of two surfaces to an upper of the two surfaces, and the second wall 140 provides a base surface supported by the lower of the two surfaces. The user 100 may also proceed to couple a portion of the carpet layer 102 to at least one of the lower of the two surfaces, the upper of the two surfaces, and a riser surface. The riser surface traverses at least a portion of an elevation between the lower of the two surfaces and the upper of the two surfaces. For example, the lower of the two surfaces may be a floor surface, and the upper of the two surfaces may be an elevated surface of a spring floor disposed on the floor surface.

The example mat 100 may be uncoupled from one or both of the two surfaces, unsecured, and unfolded for transport, storage, or other purpose. To prepare the example mat 100 for transport or storage, the user may then proceed to fold the example mat 100 around the second folding axis 128 into the rolled position. The user may start by grabbing either the first side 106 or the second side 108 and folding the example mat 100 along crease lines associated with respective base portions of the relief cuts 126. The respective base portions of the relief cuts 126 act as elastic, reversible hinges that open and close in response to displacement of the example mat 100 around the second folding axis 128. During folding of the example mat 100 into the rolled position, the user may open the relief cuts 126. Alternately, when unfolding the example mat 100 from the rolled position, the user may close the relief cuts 126. When in the rolled position, the carpeted layer 102 is inward-facing and the foam layer 104 is outward-facing.

Figure 5:
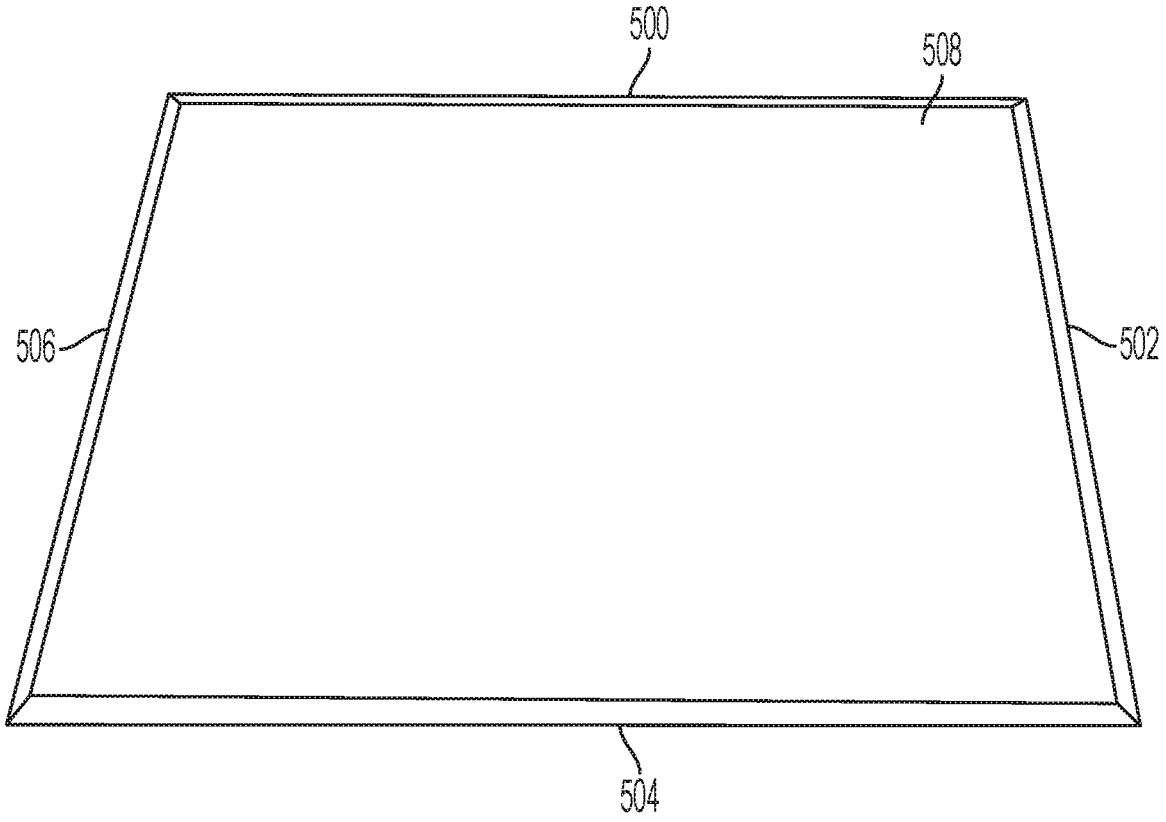
FIG. 5 is a schematic diagram, shown in perspective view, of four example mats disposed around a rectangular elevated floor.

The user may prepare multiple instances of the example mat 100, as described above, to create multiple corresponding transitions between two surfaces of different elevation. For example, FIG. 5 presents a schematic diagram, shown in perspective view, of four example mats 500, 502, 504, 506 disposed around a rectangular elevated floor 508. Example dimensions are provided for the rectangular elevated floor 508. However, other dimensions are possible. The four example mats 500, 502, 504, 506 collectively define a border around the rectangular elevated floor 508, which is a tumbling floor (e.g., for gymnastics, cheerleading, etc.). As such, a transition encircles the rectangular elevated floor 508 and allow smooth entry and departure from the tumbling surface. Although FIG. 5 depicts a rectangular geometry, other types of perimeters are possible, including curved perimeters and polygon perimeters having different numbers of sides (e.g., triangles, pentagons, hexagons, octagons, etc.).

In some aspects of what is described here, a method of forming a transition between two surfaces of different elevation includes folding a mat around a first folding axis into a folded position. The mat includes a carpeted layer secured to a foam layer. The foam layer includes first, second, third, and fourth sides that define a perimeter of the foam layer. The first side is opposite the second side, and the third side is opposite the fourth side. The foam layer also includes first and second channels extending in-plane through the foam layer from the first side to the second side. The first and second channels are configured to allow the mat to fold around the first folding axis into the folded position. The foam layer additionally includes a fifth side mated to the carpeted layer and a sixth side that defines an interior boundary of the mat when the mat is in the folded position. First portions of the carpeted and foam layers between the third side of the perimeter and the first channel define a first wall; second portions of the carpeted and foam layers between the second channel and the fourth side of the perimeter define a second wall; and the first wall is inclined relative to the second wall when the mat is in the folded position.

The method also includes placing the folded mat on a lower of the two surfaces and adjacent to an upper of the two surfaces such that the first wall provides a transition surface extending from the lower of the two surfaces to the upper of the two surfaces, and the second wall provides a base surface supported by the lower of the two surfaces. In some instances, the foam layer includes relief cuts extending in-plane through the foam layer from the third side of the perimeter to the fourth side, the relief cuts configured to allow the mat to fold around a second folding axis into a rolled position.

In some implementations, the method includes folding the mat around the second folding axis into the rolled position. In these implementations, the carpeted layer is inward-facing and the foam layer is outward-facing when the mat is in the rolled position. In some instances, folding the mat around the second folding axis may include opening the relief cuts. In some implementations, the method includes unfolding the mat around the second folding axis from the rolled position. In such implementations, the carpeted layer is also inward-facing and the foam layer is outward-facing when the mat is in the rolled position. In some instances, unfolding the mat around the second folding axis may include closing the relief cuts.

In some implementations, folding the mat around the first folding axis includes closing the first and second channels. Portions of the foam layer adjacent sides of the first and second channels may be uncompressed when the first and second channels are closed. In some implementations, the method includes unfolding the mat around the first folding axis from the folded position. Unfolding the mat around the first folding axis may include opening the first and second channels. In some implementations, folding the mat around the first folding axis includes folding the mat to have a triangular cross-section in the folded position. In some instances, the triangular cross-section defines a right triangle. In these instances, the first wall defines a hypotenuse leg of the right triangle and serves as an inclined wall that includes the transition surface.

In some implementations, the method includes coupling one or both of the carpeted layer and the foam layer proximate the third side of the perimeter to one or both of the carpeted layer and the foam layer proximate the fourth side of the perimeter. Such coupling may secure the folded mat in the folded position. In some implementations, the method includes coupling a portion of the carpet layer to at least one of the lower of the two surfaces, the upper of the two surfaces, and a riser surface. The riser surface may traverse at least a portion of an elevation between the lower of the two surfaces and the upper of the two surfaces.

In some variations, the lower of the two surfaces is a floor surface. In further variations, the upper of the two surfaces is an elevated surface of a spring floor disposed on the floor surface. Other types of surfaces are possible for the lower of the two surfaces and the upper of the two surfaces.

In some aspects of what is described here, a transition may be formed between two surfaces of different elevation. The transition may be formed by a mat, as described by the following examples:

Example 1

A mat for forming a transition between two surfaces of different elevation, the mat comprising:

a carpeted layer secured to a foam layer, the foam layer comprising:

first, second, third, and fourth sides that define a perimeter of the foam layer, the first side opposite the second side, the third side opposite the fourth side;

first and second channels extending in-plane through the foam layer from the first side to the second side, the first and second channels configured to allow the mat to fold around a first folding axis into a folded position, relief cuts extending in-plane through the foam layer from the third side to the fourth side, the relief cuts configured to allow the mat to fold around a second folding axis into a rolled position, a fifth side mated to the carpeted layer, and a sixth side that defines an interior boundary of the mat when the mat is in the folded position.

Example 2

The mat of example 1, wherein the foam layer is configured such that the carpeted layer is inward-facing and the foam layer is outward-facing when the mat is in the rolled position.

Example 3

The mat of example 1 or example 2, wherein the first and second channels are parallel to each other, and the relief cuts are parallel to each other.

Example 4

The mat of example 1 or any one of examples 2-3, wherein the relief cuts are perpendicular to the first and second channels, and the second folding axis is perpendicular to the first folding axis.

Example 5

The mat of example 1 or any one of examples 2-4, wherein first portions of the carpeted and foam layers between the third side of the perimeter and the first channel define a first wall, the first wall comprising a transition surface configured to extend from the lower of the two surfaces to the upper of the two surfaces when the mat is in the folded position;

wherein second portions of the carpeted and foam layers between the second channel and the fourth side of the perimeter define a second wall;

wherein third portions of the carpeted and foam layers between the first and second channels define a third wall.

Example 6

The mat of example 5, wherein, when the mat is in the folded position:

the first wall is inclined relative to the second wall and the transition surface comprises an inclined surface; and the second wall comprises a base surface configured to be supported by the lower of the two surfaces.

Example 7

The mat of example 6, wherein a beveled surface terminates the carpeted and foam layers at the third side; and wherein the beveled surface is angled with respect to the sixth side of the foam layer to allow the beveled surface to serve as part of the base surface of the mat when the mat is in the folded position.

Example 8

The mat of example 1 or any one of examples 2-7, wherein the carpeted layer has a thickness less than a thickness of the foam layer.

Example 9

The mat of example 1 or any one of examples 2-8, wherein a distance from the fifth side to the sixth side defines a thickness of the foam layer, and the first and second channels have a depth from the sixth side that is less than the thickness of the foam layer.

Example 10

The mat of example 1 or any one of examples 2-7, wherein the first and second channels have a depth extending through the foam layer to the carpeted layer.

Example 11

The mat of example 1 or any one of examples 2-10, wherein the foam layer is configured such that the first and second channels are closed when the mat is in the folded position.

Example 12

The mat of example 1, wherein the foam layer is configured such that portions of the foam layer adjacent sides of the first and second channels are uncompressed when the first and second channels are closed.

Example 13

The mat of example 1 or any one of examples 2-12, wherein the mat is configured such that, when the mat is in the folded position, the mat has a triangular cross-section.

Example 14

The mat of example 13, wherein the triangular cross-section defines a right triangle and a portion of the mat defining a hypotenuse leg of the right triangle serves as an inclined wall capable providing the transition between the two surfaces of different elevation.

Example 15

The mat of example 1 or any one of examples 2-14, wherein a distance from the fifth side to the sixth side defines a thickness of the foam layer, and the relief cuts have a depth from the sixth side that is equal to the thickness of the foam layer.

Example 16

The mat of example 1 or any one of examples 2-15, wherein the perimeter is a rectangular perimeter when the mat is laid flat.

Example 17

The mat of example 1 or any one of examples 2-15, wherein the first side or the second side comprise a pair of angled portions such that the perimeter defines, at least partially, a V-shaped indent when the mat is laid flat.

Example 18

The mat of example 1 or any one of examples 2-15, wherein the first side and the second side each comprise a pair of angled portions such that the perimeter defines, at least partially, a bow-tie shape when the mat is laid flat.

Example 19

The mat of example 1 or any one of examples 2-18, wherein the relief cuts define grooves extending in-plane through the foam layer from the third side of the perimeter to the fourth side.

Example 20

The mat of example 1 or any one of examples 2-18, wherein the relief cuts define slits extending in-plane through the foam layer from the third side of the perimeter to the fourth side.

Example 21

The mat of example 1 or any one of examples 2-20, wherein the mat is sized such that the mat, when in the folded position, can form a walking surface between a spring floor and a base floor that supports the spring floor.

In some aspects of what is described here, a method may be used to form a transition between two surfaces of different elevation. The method may use a mat to form the transition, as described by the following examples:

Example 22

A method of forming a transition between two surfaces of different elevation, the method comprising:

folding a mat around a first folding axis into a folded position, the mat comprising:

a carpeted layer secured to a foam layer, the foam layer comprising:

first, second, third, and fourth sides that define a perimeter of the foam layer, the first side opposite the second side, the third side opposite the fourth side;

first and second channels extending in-plane through the foam layer from the first side to the second side, the first and second channels configured to allow the mat to fold around the first folding axis into the folded position;

a fifth side mated to the carpeted layer; and a sixth side that defines an interior boundary of the mat when the mat is in the folded position;

wherein first portions of the carpeted and foam layers between the third side of the perimeter and the first channel define a first wall, second portions of the carpeted and foam layers between the second channel and the fourth side of the perimeter define a second wall, and the first wall is inclined relative to the second wall when the mat is in the folded position;

placing the folded mat on a lower of the two surfaces and adjacent to an upper of the two surfaces such that:

the first wall provides a transition surface extending from the lower of the two surfaces to the upper of the two surfaces; and the second wall provides a base surface supported by the lower of the two surfaces.

Example 23

The method of example 22, wherein the foam layer comprises:

relief cuts extending in-plane through the foam layer from the third side of the perimeter to the fourth side, the relief cuts configured to allow the mat to fold around a second folding axis into a rolled position.

Example 24

The method of example 23, comprising:

folding the mat around the second folding axis into the rolled position;

wherein the carpeted layer is inward-facing and the foam layer is outward-facing when the mat is in the rolled position.

Example 25

The method of example 24, wherein folding the mat around the second folding axis comprises opening the relief cuts.

Example 26

The method of example 23 or any one of examples 24-25, comprising:

unfolding the mat around the second folding axis from the rolled position;

wherein the carpeted layer is inward-facing and the foam layer is outward-facing when the mat is in the rolled position.

Example 27

The method of example 26, wherein unfolding the mat around the second folding axis comprises closing the relief cuts.

Example 28

The method of example 22 or any one of examples 23-27, wherein folding the mat around the first folding axis comprises closing the first and second channels.

Example 29

The method of example 28, wherein portions of the foam layer adjacent sides of the first and second channels are uncompressed when the first and second channels are closed.

Example 30

The method of example 22 or any one of examples 23-29, comprising unfolding the mat around the first folding axis from the folded position.

Example 31

The method of example 30, wherein unfolding the mat around the first folding axis comprises opening the first and second channels.

Example 32

The method of example 22 or any one of examples 23-31, wherein folding the mat around the first folding axis comprises folding the mat to have a triangular cross-section in the folded position.

Example 33

The method of example 32, wherein the triangular cross-section defines a right triangle; and wherein the first wall defines a hypotenuse leg of the right triangle and serves as an inclined wall that comprises the transition surface.

Example 34

The method of example 22 or any one of examples 23-33, comprising:

coupling one or both of the carpeted layer and the foam layer proximate the third side of the perimeter to one or both of the carpeted layer and the foam layer proximate the fourth side of the perimeter to secure the folded mat in the folded position.

Example 35

The method of example 22 or any one of examples 23-34, comprising:

coupling a portion of the carpet layer to at least one of the lower of the two surfaces, the upper of the two surfaces, and a riser surface;

wherein the riser surface traverses at least a portion of an elevation between the lower of the two surfaces and the upper of the two surfaces.

Example 36

The method of example 22 or any one of examples 23-35, wherein the lower of the two surfaces is a floor surface.

Example 37

The method of example 36, wherein the upper of the two surfaces is an elevated surface of a spring floor disposed on the floor surface.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

As used herein, the term "at least one", when used with the conjunction "and" to describe two or more features, refers to any combination of the two or more features in which a single feature, if present, has a quantity of at least one. For example, "at least one" of feature A "and" feature B refers to any of three possible combinations: [1] at least one of feature A, [2] at least one of feature B, or [3] at least one of feature A and at least one of feature B. Similarly, "at least one" of feature A, feature B, "and" feature C refers to any of seven possible combinations: [1] at least one of feature A, [2] at least one of feature B, [3] at least one of feature C, [4] at least one of feature A and at least one of feature B, [5] at least one of feature A and at least one of feature C, [6] at least one of feature B and at least one of feature C, or [7] at least one of feature A, at least one of feature B, and at least one of feature C.

A number of embodiments have been described. Nevertheless, it will be understood that various modifications can be made. Accordingly, other embodiments are within the scope of the following claims.

What is claimed is:

1. A mat for forming a transition between two surfaces of different elevation, the mat comprising:

a carpeted layer secured to a foam layer, the foam layer comprising:

first, second, third, and fourth sides that define a perimeter of the foam layer, the first side opposite the second side, the third side opposite the fourth side;

first and second channels extending in-plane through the foam layer from the first side to the second side, the first and second channels configured to allow the mat to fold around a first folding axis into a folded position, relief cuts extending in-plane through the foam layer from the third side to the fourth side, the relief cuts configured to allow the mat to fold around a second folding axis into a rolled position, a fifth side mated to the carpeted layer, and a sixth side that defines an interior boundary of the mat when the mat is in the folded position;

wherein:

first portions of the carpeted and foam layers between the third side of the perimeter and the first channel define a first wall, the first wall comprising a transition surface configured to extend from the lower of the two surfaces to the upper of the two surfaces when the mat is in the folded position, second portions of the carpeted and foam layers between the second channel and the fourth side of the perimeter define a second wall, and third portions of the carpeted and foam layers between the first and second channels define a third wall; and wherein, when the mat is in the folded position:

the first wall is inclined relative to the second wall and the transition surface comprises an inclined surface, and the second wall comprises a base surface configured to be supported by the lower of the two surfaces.

2. The mat of claim 1, wherein the first and second channels are parallel to each other, and the relief cuts are parallel to each other.

3. The mat of claim 1, wherein the relief cuts are perpendicular to the first and second channels, and the second folding axis is perpendicular to the first folding axis.

4. The mat of claim 1, wherein a beveled surface terminates the carpeted and foam layers at the third side; and wherein the beveled surface is angled with respect to the sixth side of the foam layer to allow the beveled surface to serve as part of the base surface of the mat when the mat is in the folded position.

5. The mat of claim 1, wherein the foam layer is configured such that the first and second channels are closed when the mat is in the folded position.

6. The mat of claim 1, wherein the foam layer is configured such that portions of the foam layer adjacent sides of the first and second channels are uncompressed when the first and second channels are closed.

7. The mat of claim 1, wherein the mat is configured such that, when the mat is in the folded position, the mat has a triangular cross-section.

8. The mat of claim 7, wherein the triangular cross-section defines a right triangle and a portion of the mat defining a hypotenuse leg of the right triangle serves as an inclined wall capable providing the transition between the two surfaces of different elevation.

9. The mat of claim 1, wherein the mat is sized such that the mat, when in the folded position, can form a walking surface between a spring floor and a base floor that supports the spring floor.

* * * * *